US011097875B2

(12) United States Patent
Starner

(10) Patent No.: US 11,097,875 B2
(45) Date of Patent: Aug. 24, 2021

(54) DUAL BALL VALVE STRAW LID FOR CLOSED CONTAINER

(71) Applicant: Alan Lee Starner, Eugene, OR (US)

(72) Inventor: Alan Lee Starner, Eugene, OR (US)

( * ) Notice: Subject to any disclaimer, the term of this patent is extended or adjusted under 35 U.S.C. 154(b) by 9 days.

(21) Appl. No.: 16/460,826

(22) Filed: Jul. 2, 2019

(65) Prior Publication Data

US 2021/0002041 A1 Jan. 7, 2021

(51) Int. Cl.
*B65D 47/32* (2006.01)
*B65D 47/06* (2006.01)

(52) U.S. Cl.
CPC ..... *B65D 47/32* (2013.01); *B65D 47/066* (2013.01)

(58) Field of Classification Search
CPC ..... B65D 47/32; B65D 47/065–066; B65D 47/305; B65D 51/1672; B65D 81/18; A47G 19/2272; A47G 19/2266; A47G 19/2288; A47G 21/18; A47G 2019/122; A47J 41/0027; A45F 3/16; B67D 3/048; B67D 7/005
USPC ..... 220/203.02, 203.01, 840, 253, 254.3, 220/254.6, 258.5, 288, 361, 4.21, 705, 220/708, 810, 819, 836–837; 215/229, 215/235, 245, 387–389, 902; 222/533, 222/536, 537, 544, 556, 562, 566–568; 251/110, 113, 155, 172, 310, 317, 91; D7/396.2, 397; D9/450, 435
See application file for complete search history.

(56) References Cited

U.S. PATENT DOCUMENTS 1,250,081 A * 12/1917 Bennis ..... B65D 47/061 222/488
1,259,057 A * 3/1918 Vick ..... B65D 47/066 222/83
2,701,668 A * 2/1955 Zayan ..... B65D 47/305 222/484
2,929,406 A * 3/1960 Anderson ..... F16K 27/067 137/615
2,936,934 A * 5/1960 Kubiliunas ..... B65D 47/305 222/484
2,971,664 A * 2/1961 Jacob ..... B65D 47/305 222/482
2,979,238 A * 4/1961 Bramming ..... A47G 21/18 222/484
3,023,939 A * 3/1962 Gustafson ..... B65D 47/305 222/536
3,089,626 A * 5/1963 Kubiliunas ..... B65D 47/305 222/484

(Continued)

*Primary Examiner* — Chun Hoi Cheung
*Assistant Examiner* — Brijesh V. Patel

(57) ABSTRACT

A dual ball valve straw lid assembly for a closed container is provided. The dual ball valve straw lid assembly includes one or more of a lid, a liquid ball, a vent ball, and a tube. The lid includes a top and a bottom, and the bottom is configured to attach to the closed container. Each of the liquid and vent balls are pivotably coupled to the lid top and each configured to rotate between open and closed positions. The vent ball is configured to rotate in response to the liquid ball rotates. The tube extends from the lid bottom to within the closed container, and allows liquid in the closed container to be accessed by suction force applied to the liquid ball in the open position. When open, the vent ball allows air to pass between outside and inside the closed container when in the open position.

16 Claims, 8 Drawing Sheets

(56) References Cited

U.S. PATENT DOCUMENTS 3,502,248 A * 3/1970 Newby ..... B65D 47/305 222/534
3,542,256 A * 11/1970 Waterman ..... B65D 47/305 222/484
3,965,935 A * 6/1976 Morisseau ..... F16K 11/0782 137/625.4
4,519,529 A * 5/1985 Seitz ..... B65D 47/305 222/484
4,629,121 A * 12/1986 Hengesbach ..... B05B 1/1636 239/119
4,732,303 A * 3/1988 Wang ..... B65D 47/305 222/484
4,946,079 A * 8/1990 Campbell ..... B67D 3/048 222/484
5,065,881 A * 11/1991 Tarng ..... B65D 47/28 220/258.5
6,341,716 B1 * 1/2002 Goettner ..... B65D 47/305 222/129
8,459,502 B2 * 6/2013 Swanick ..... B65D 47/32 222/83
8,839,977 B2 * 9/2014 Yang ..... A45F 3/18 220/375
8,863,997 B2 * 10/2014 Hickey ..... B67D 7/005 222/484
9,010,952 B2 * 4/2015 Lenahan ..... B65D 51/248 362/101
9,573,738 B1 * 2/2017 Lai ..... B65D 47/305
9,771,195 B2 * 9/2017 Lawson ..... B65D 47/32
2010/0193462 A1 * 8/2010 Roth ..... B65D 81/18 215/229
2012/0305559 A1 * 12/2012 Steininger ..... B65D 51/1672 220/253
2017/0190481 A1 * 7/2017 Leimone ..... B65D 47/066
2018/0050850 A1 * 2/2018 Murosky ..... B65D 47/2043

* cited by examiner

DUAL BALL VALVE STRAW LID FOR CLOSED CONTAINER

CROSS REFERENCE TO RELATED APPLICATION(S)

This application claims priority to earlier filed provisional application No. 62/764,454 filed Aug. 8, 2018 and entitled "DUAL BALL VALVE FOR CLOSED CONTAINER", the entire contents of which are hereby incorporated by reference.

FIELD

The present invention is directed to systems for accessing closed containers, and more specifically to equalizing pressures within and outside closed containers prior to closed container liquid access.

BACKGROUND

Water bottles have become very popular, especially for those who are active in sports and other physical activities. There are different types of tops for these water bottles that prevent spills when closed and allow for the user to drink when open. The simplest top simply screws on and off, but other designs allow for faster access for drinking. This includes the "straw lid" design which has a straw connected to the lid so that the liquid can be easily drawn out by suction.

SUMMARY

The present invention is directed to solving disadvantages of the prior art. In accordance with embodiments of the present invention, a dual ball valve straw lid assembly for a closed container is provided. The dual ball valve straw lid assembly includes one or more of a lid, a liquid ball, a vent ball, and a tube. The lid includes a top and a bottom, and the bottom is configured to attach to the closed container. Each of the liquid and vent balls are pivotably coupled to the lid top and each configured to rotate between open and closed positions. The vent ball is configured to rotate in response to the liquid ball rotates. The tube extends from the lid bottom to within the closed container, and is configured to allow liquid in the closed container to be accessed by suction force applied to the liquid ball in the open position. The vent ball is configured to allow air to pass therethrough between outside and inside the closed container when in the open position.

One advantage of the present invention is that it provides a leak-proof seal when closed. This allows the bottle to be placed on its side with other belongings without risking a spill.

Another advantage of the present invention is that it provides a free flow of air into a closed container as liquid is drawn out. If air pressure inside and outside the closed container is not equalized quickly, a partial vacuum will build up, increasing the effort to access the liquid.

Another advantage of the present invention is that it provides air venting for a closed container prior to liquid access. This allows air inside the closed container to equalize in pressure to air outside the closed container, preventing backflow pressure up the straw, which in turn may soak the user. This also allows the straw to be used with carbonated beverages.

Additional features and advantages of embodiments of the present invention will become more readily apparent from the following description, particularly when taken together with the accompanying drawings. This overview is provided to introduce a selection of concepts in a simplified form that are further described below in the detailed description. It may be understood that this overview is not intended to identify key features or essential features of the claimed subject matter, nor is it intended to be used to limit the scope of the claimed subject matter.

DETAILED DESCRIPTION

Many of closed container lids or straw caps use a ball valve or similar valve to close access to the straw when not in use to prevent spills. These sometimes incorporate a small one-way air valve that allows air to come into the container, but does not allow air or liquid to be released. By allowing air to enter, the user may suck liquid or fluid, and air can come in through the one-way valve to take the place of the displaced liquid. While this may work, the amount of suction required to draw up the liquid is increased by the suction required to activate the one-way air valve. A larger problem with these designs is that pressure can build up in the container (for example when left in the sun), and when the ball valve is opened, this pressure will release back up through a straw spraying liquid out the top, and sometimes onto a user.

A second method exists for allowing air to enter the container to equalize the pressure as liquid is drawn out which incorporates a pin hole valve. Usually the pin hole is formed of silicone or similar compliant material, and the drinking spout has a small spike on it that presses into the pin hole when the spout is in the closed position, resisting leaks. The pin hole is small, which limits the rate that air can enter, which in turn increases the effort required to draw liquid up the straw. Additionally, the pin hole valves may be prone to leaking if the spout is not in a fully closed position, and also when pressure builds up inside the bottle or closed container.

Therefore, there is a need for a straw lid for a closed container that will depressurize the container before opening up the straw to the liquid, have a larger air vent to minimize vacuum resistance, and to seal effectively to prevent leaking while in a closed position. The instant inventive dual ball valve straw lid for closed container addresses these disadvantages.

Accordingly, a broad object of the present invention is to provide a straw lid system for a closed container that incorporates a two mechanically coupled ball valves; one for liquid and one for venting air whereby, when moving from a closed position to an open position, the secondary air vent will be activated before the liquid hole is activated—thus allowing pressure to be equalized before the liquid can reverse up the straw and cause a spill.

A second broad object of the present invention is to provide a ball valve that will allow free air venting when in the open position to reduce the effort required to suck liquid up the straw, and will prevent leaks of liquid in the closed position.

Figure 1A:
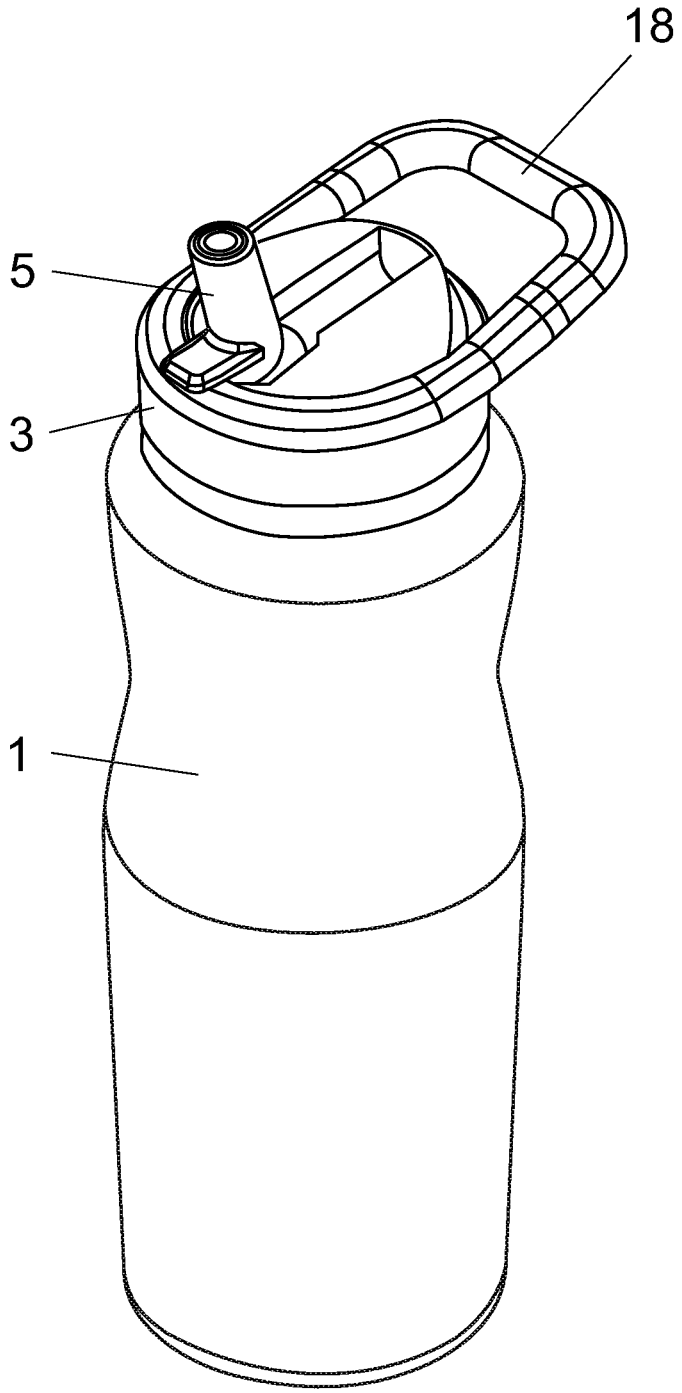
FIG. 1A is a top isometric view of a closed container with a dual ball valve straw lid assembly in an open position in accordance with a first embodiment of the present invention.

Referring now to FIG. 1A, a top isometric view of a closed container and a dual ball valve straw lid assembly in an open position in accordance with a first embodiment of the present invention is shown. FIG. 1A illustrates a dual ball valve straw lid assembly including a lid (3) which is coupled to a bottle or closed container (1). The dual ball valve straw lid assembly includes a dual ball spout (5) for a user to access a liquid or fluid within the bottle (1). In some embodiments, the lid (3) may include a carrying handle (18) to facilitate carrying by individuals.

The above describes the preferred embodiment as being of a size common for water bottles, but the same disclosure may be applied to larger or smaller scales. For example, it could be used to access a liquid inside a steel drum or other container (1) used for industrial purposes.

Figure 1B:
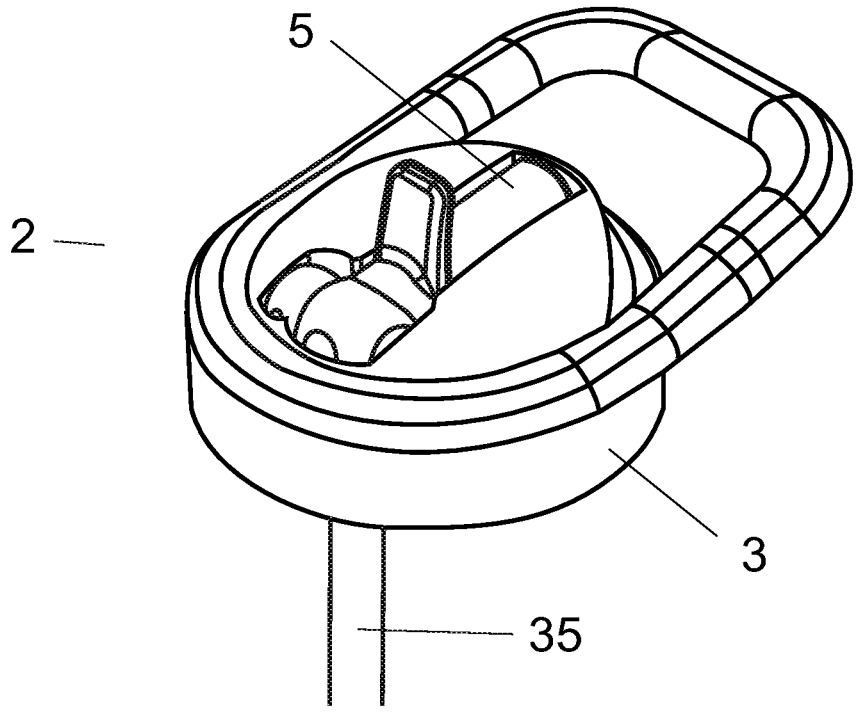
FIG. 1B is a top isometric view of a dual ball valve straw lid assembly in a closed position in accordance with a first embodiment of the present invention.

Referring now to FIG. 1B, a top isometric view of a dual ball valve straw lid assembly (2) in a closed position in accordance with a first embodiment of the present invention is shown. FIG. 1B illustrates the lid (3) removed from the closed container (1), and the dual ball spout (5) in the closed position. The dual ball spout (5) is arranged within a top portion of the lid (3). The dual ball valve straw lid assembly (2) also includes a tube (35) for accessing fluid within the closed container (1).

Figure 2:
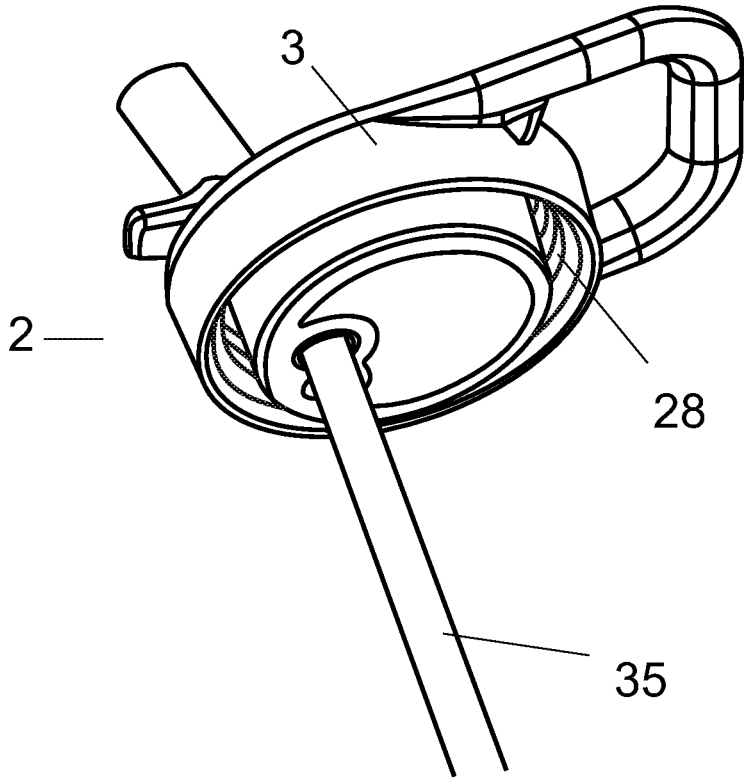
FIG. 2 is a bottom isometric view of a dual ball valve straw lid assembly in the open position in accordance with embodiments of the present invention.

Referring now to FIG. 2, a bottom isometric view of a dual ball valve straw lid assembly (2) in the open position in accordance with embodiments of the present invention is shown. The dual ball valve straw lid assembly (2) is typically screwed onto the closed container (1) via bottle threads (not shown) and matching lid threads (28). The threads secure and seal the dual ball valve straw lid assembly (2) to the closed container (1).

In one embodiment, the tube (35) is a straw, and preferably extends almost to the bottom of the closed container (1) when the lid (3) is securely attached to the closed container (1). With the dual ball valve straw lid assembly (2) in the open position as shown, fluid may be drawn out of the closed container (1) through the tube (35).

Figure 3:
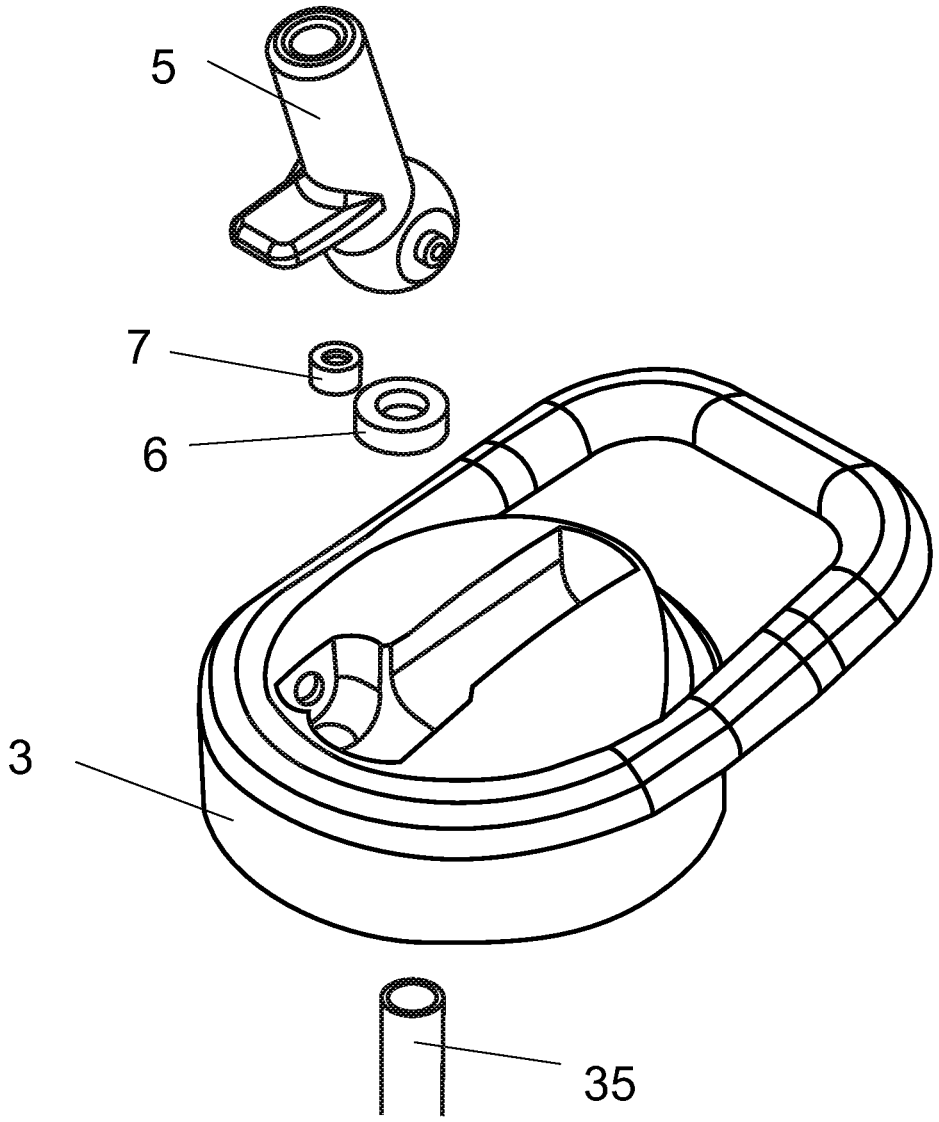
FIG. 3 is a top exploded isometric view of a dual ball valve straw lid assembly in accordance with a first embodiment of the present invention.

Referring now to FIG. 3, a top exploded isometric view of a dual ball valve straw lid assembly (2) in accordance with a first embodiment of the present invention is shown. The dual ball valve straw lid assembly (2) includes the dual ball spout (5), the lid (3), and the tube (35). A liquid seal (6) is positioned within a liquid seal cavity (23) of the lid (3), and is disposed between the dual ball spout (5) and the lid (3). A vent seal (7) is positioned within a vent seal cavity (22) of the lid (3), and is disposed between the dual ball spout (5) and the lid (3). The dual ball spout (5) is compressed against the liquid seal (6) and the vent seal (7). Although the vent seal (7) appears smaller in diameter than the liquid seal (6), it should be understood that both seals (6), (7) may be the same size or different sizes. In one embodiment, one or both seals (6), (7) may be a compressible material such as silicone or rubber.

Figure 4:
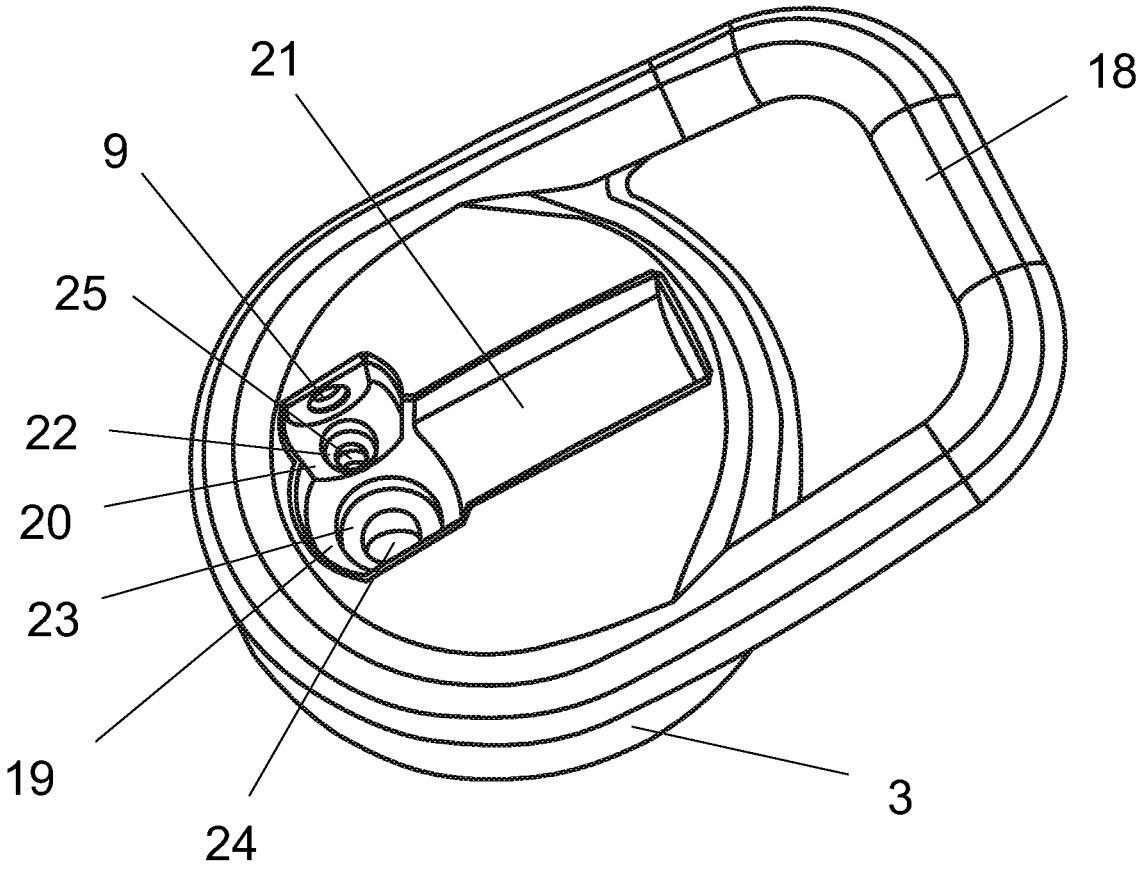
FIG. 4 is a top isometric view of a lid with liquid and vent balls removed in accordance with a first embodiment of the present invention.

Referring now to FIG. 4, a top isometric view of a lid (3) with liquid and vent balls removed in accordance with a first embodiment of the present invention is shown. FIG. 4 illustrates various details of the lid (3) top. A liquid seal cavity (23) provides a precise location of the liquid seal (6) within a liquid ball housing (19). Similarly, a vent seal cavity (22) provides a precise location for the vent seal (7) within a vent ball housing (20). The liquid ball housing (19), vent ball housing (20), and a spout cavity (21) provide space in the lid (3) to receive the dual ball spout (5).

A lid liquid hole (24) provides liquid access to the closed container (1) through the lid (3). A lid vent hole (25) provides air access to the closed container (1) through the lid (3), and provides a path for pressurized air to escape the closed container (1) as explained in detail later.

Also visible in FIG. 4 is a spout pivot cavity (9), which is a recess that receives a spout pivot (33) of the dual ball spout (5). In the preferred embodiment, there are two spout pivot cavities (9) present—one in the vent seal cavity (22) as shown and a second in the liquid seal cavity (23), which is not shown.

Figure 5:
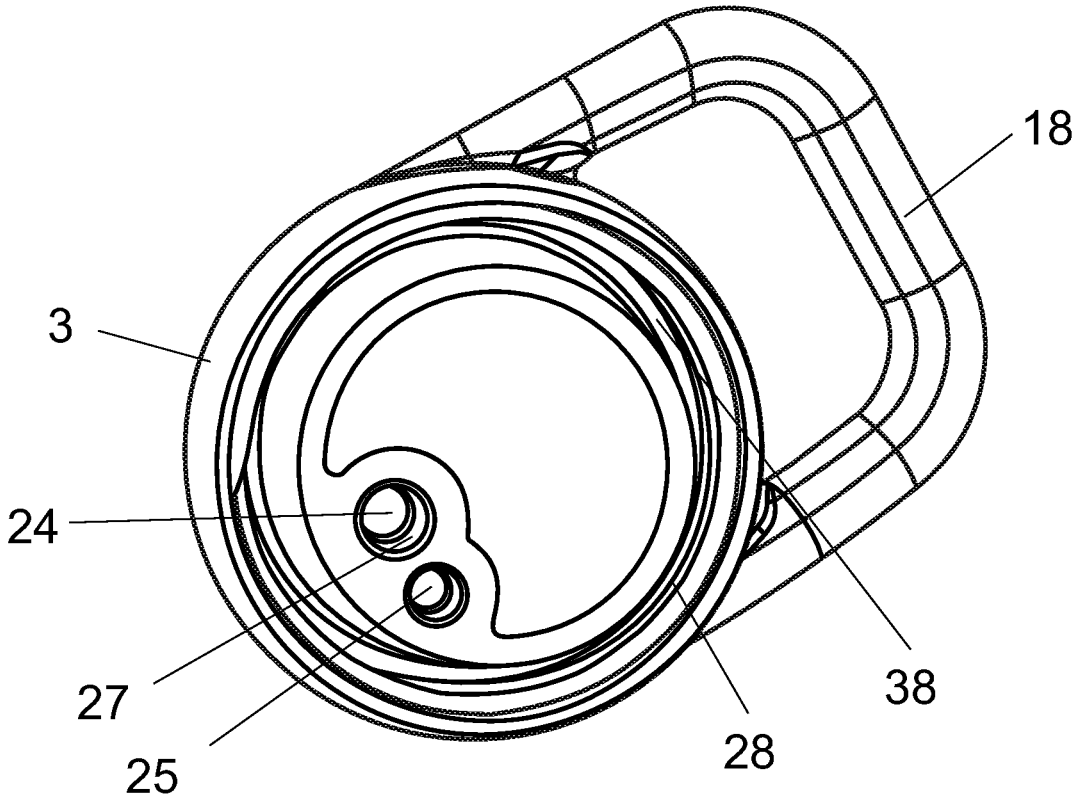
FIG. 5 is a bottom view of a lid with a tube removed in accordance with embodiments of the present invention.

Referring now to FIG. 5, a bottom view of a lid (3) with a tube (35) removed in accordance with embodiments of the present invention is shown. FIG. 5 illustrates various details of the lid (3) bottom.

A tube receiver (27) allows for compressive insertion of the tube (35) into the Lid (3) bottom, and is preferably concentric with lid liquid hole (24). A top end of the tube (35) is inserted into the tube receiver (27) and extends from the lid (3) down into the closed container (1) to access the liquid within the closed container (1).

The lid threads (28) are molded into the sides of lid (3) bottom, and provide a means for attaching the lid (3) to the closed container (1). A lid sealing surface (38) may seal the lid (3) bottom to the closed container (1). In some embodiments, the lid sealing surface (38) may incorporate a gasket or other compressible seal. When the dual ball spout (5) is in the open position, the lid vent hole (25) provides a path for air to enter the closed container (1) to compensate for liquid removed by suction force.

Figure 6:
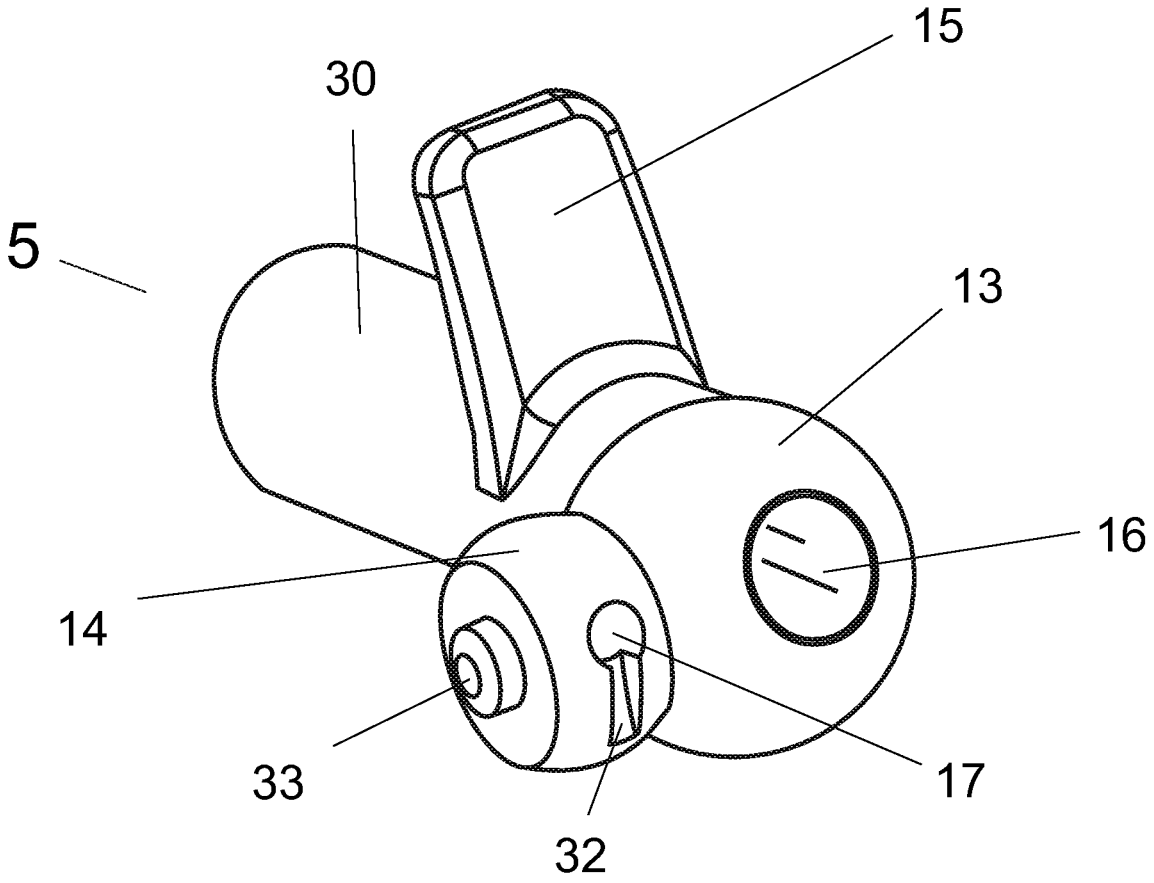
FIG. 6 is a first side isometric view of a liquid and a vent ball in accordance with a first embodiment of the present invention.

Referring now to FIG. 6, a first side isometric view of a dual ball spout (5) in accordance with a first embodiment of the present invention is shown. FIG. 6 illustrates details of the dual ball spout (5), and represents a preferred embodiment of the present invention. The dual ball spout (5) may be divided into four sections rigidly attached to each other: a liquid ball (13), a vent ball (14), a spout shaft (30), and a ball valve handle (15).

The ball valve handle (15) is used to rotate the dual ball spout (5), which rotates the liquid ball (13) and vent ball (14) simultaneously. The vent ball (14) has the vent ball hole (17) disposed through it.

When the dual ball spout (5) is in the closed position (FIG. 1B), the liquid seal (6) and vent seal (7) are pressed against the surface of the liquid ball (13) and vent ball (14) respectively, sealing them to the lid (3) and thus sealing the contents inside the closed container (1).

When the dual ball spout (5) is in the open position (FIG. 1A), the liquid ball hole (16) is positioned directly over the opening in the liquid seal (6), and the vent ball hole (17) is positioned directly over the opening in the vent seal (7). In the open position, air may easily pass through the vent ball hole (17) and the lid vent hole (25) into the closed container (1), thus equalizing the pressure inside the closed container (1) with the surrounding air.

The dual ball spout (5) is free to rotate about the spout pivots (33). When the dual ball spout (5) is rotated into the open position (FIG. 1A), the liquid ball hole (16) is aligned with the lid liquid hole (24) and the vent ball hole (17) is aligned with the lid vent hole (25). This position is used for accessing the liquid by suction force from the closed container (1) via the mouthpiece hole (31), and allows air to equalize pressure through the lid vent hole (25). When suction force is applied to the mouthpiece hole (31), a low pressure is transmitted through the spout shaft (30), the liquid ball hole (16), the lid liquid hole (24), and the tube (35) down into the closed container (1). The liquid seal (7) provides a sealed connection between the dual ball spout (5) and the lid (3).

In some embodiments, there may be a vent slot (32) molded into the vent ball (14) at its bottom surface, adjacent and connected to the vent ball hole 17. The width of the vent slot (32) should preferably be such that it's angular displacement about the spout pivot axis is larger than the radius of the liquid ball hole (16). Where the container's (1) contents have become pressurized due to heating or other means, rotating the dual ball spout (5) from the closed position toward the open position will expose the vent slot (32) to the hole in the vent seal (7), before the liquid ball hole (16) reaches the opening in the liquid seal (6). This will allow the higher air pressure in the closed container (1) to dissipate and equalize with air pressure outside the closed container (1) before the liquid ball hole (16) rotates sufficiently to provide access to the container's contents.

Figure 7:
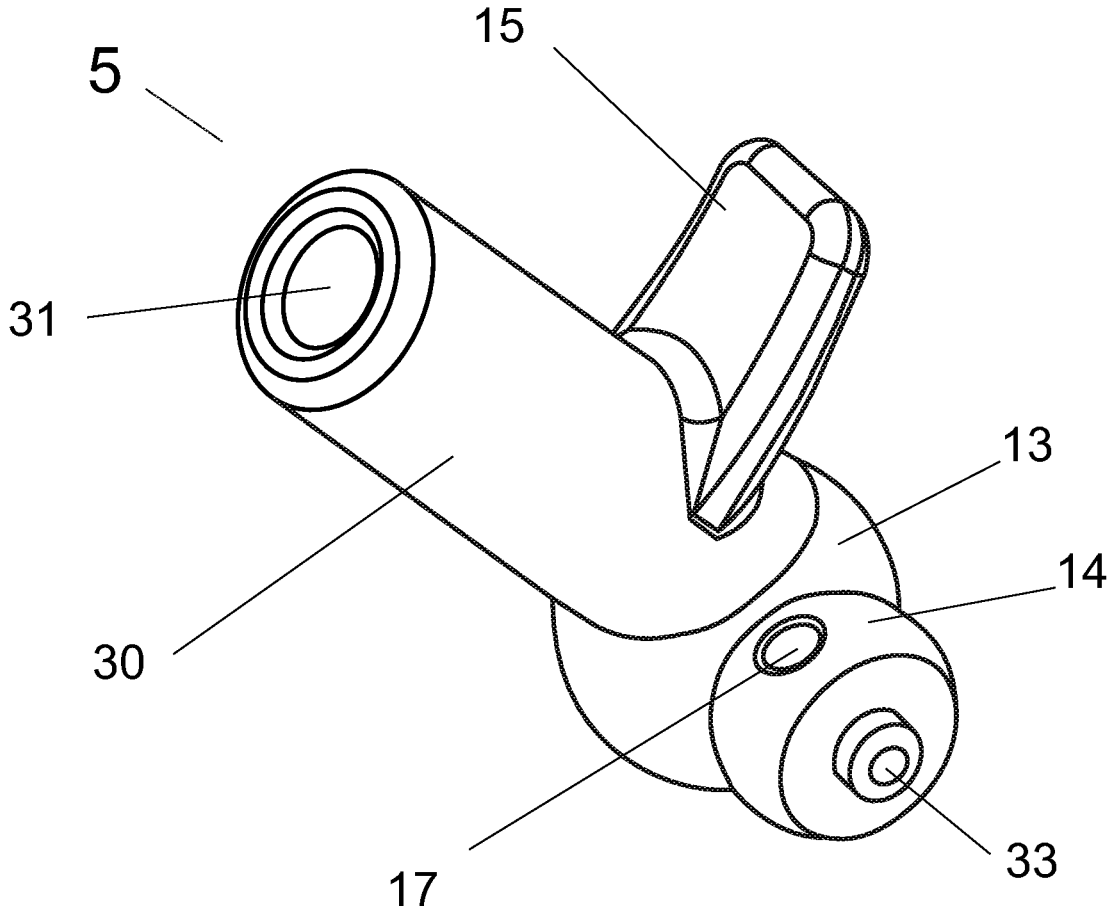
FIG. 7 is a second side isometric view of a liquid and a vent ball in accordance with a first embodiment of the present invention.

Although FIGS. 6 and 7 illustrate a liquid ball (13) and a vent ball (14) of generally rounded exterior appearance, in other embodiments the balls could alternately be cylindrical in shape rather than spherical, or any shape that has radial symmetry.

Referring now to FIG. 7, a second side isometric view of a dual ball spout (5) in accordance with a first embodiment of the present invention is shown. FIG. 7 illustrates additional details of the dual ball spout (5), and represents a preferred embodiment of the present invention.

The spout shaft (30) is attached to the liquid ball (13) and connects the liquid ball hole (16) to a mouthpiece hole (31). The liquid ball (14) has the liquid ball hole (16) disposed though it to the Mouthpiece Hole (31).

Suction force applied to the mouthpiece hole (31) of the dual ball spout (5) will pull the liquid in the closed container (1) up the tube (35), into the dual ball spout (5), and out the mouthpiece hole (31). The Vent Ball (14) has Vent Ball Hole (17) disposed through it.

The various views and illustrations of closed containers and lids provided in the Figures are representative of exemplary systems, environments, and methodologies for performing novel aspects of the disclosure. For example, those skilled in the art will understand and appreciate that a component could alternatively be represented as a group of interrelated sub-components attached through various temporarily or permanently configured means. Moreover, not all components illustrated herein may be required for a novel embodiment, in some components illustrated may be present while others are not.

The descriptions and Figures included herein depict specific embodiments to teach those skilled in the art how to make and use the best option. For the purpose of teaching inventive principles, some conventional aspects have been simplified or omitted. Those skilled in the art will appreciate variations from these embodiments that fall within the scope of the invention. Those skilled in the art will also appreciate that the features described above can be combined in various ways to form multiple embodiments. As a result, the invention is not limited to the specific embodiments described above, but only by the claims and their equivalents.

As such, the particular embodiments or elements of the invention disclosed by the description or shown in the figures or tables accompanying this application are not intended to be limiting, but rather exemplary of the numerous and varied embodiments generically encompassed by the invention or equivalents encompassed with respect to any particular element thereof. In addition, the specific description of a single embodiment or element of the invention may not explicitly describe all embodiments or elements possible; many alternatives are implicitly disclosed by the description and figures.

In addition, as to each term used it should be understood that unless its utilization in this application is inconsistent with such interpretation, common dictionary definitions should be understood to included in the description for each term as contained in the Random House Webster's Unabridged Dictionary, second edition, each definition hereby incorporated by reference.

Thus, the applicant(s) should be understood to claim at least: i) each of the dual ball valve straw lid assembly for closed container herein disclosed and described, ii) the related methods disclosed and described, iii) similar, equivalent, and even implicit variations of each of these devices and methods, iv) those alternative embodiments which accomplish each of the functions shown, disclosed, or described, v) those alternative designs and methods which accomplish each of the functions shown as are implicit to accomplish that which is disclosed and described, vi) each feature, component, and step shown as separate and independent inventions, vii) the applications enhanced by the various systems or components disclosed, viii) the resulting products produced by such systems or components, ix) methods and apparatuses substantially as described hereinbefore and with reference to any of the accompanying examples, x) the various combinations and permutations of each of the previous elements disclosed.

Finally, those skilled in the art should appreciate that they can readily use the disclosed conception and specific embodiments as a basis for designing or modifying other structures for carrying out the same purposes of the present invention without departing from the spirit and scope of the invention as defined by the appended claims.

I claim:

1. A dual ball valve straw lid assembly for a closed container, comprising:

a lid comprising a lid top and a lid bottom, the lid bottom configured to attach to the closed container;

a liquid ball;

a vent ball, each of the liquid and vent balls pivotably coupled to the lid top and each configured to rotate between an open position and a closed position, the vent ball configured to rotate in response to the liquid ball rotation; and a tube that extends from the lid bottom to within the closed container and configured to allow liquid in the closed container to be accessed by suction force applied to the liquid ball in the open position, the vent ball configured to allow air to pass therethrough between outside and inside the closed container when in the open position.

2. The dual ball valve straw lid assembly of claim 1, wherein the liquid ball and the vent ball are formed from a common portion of material.

3. The dual ball valve straw lid assembly of claim 1, as the liquid ball and the vent ball rotate from the closed position to the open position, the vent ball allows air to pass therethrough between outside and inside the closed container before liquid is accessible from the liquid ball, thereby equalizing air pressure between outside air and an interior of the closed container prior to liquid access.

4. The dual ball valve straw lid assembly of claim 3, wherein the lid further comprises a lid liquid hole and a lid vent hole, when in the open position, a liquid ball hole is in alignment with the lid liquid hole and a vent ball hole is in alignment with the lid vent hole, respectively, wherein liquid within the closed container is accessed through a path comprising the liquid ball hole, the lid liquid hole, and the tube, wherein air is equalized through a path comprising the vent ball hole and the lid vent hole.

5. The dual ball valve straw lid assembly of claim 4, wherein the liquid ball comprises a spout shaft coupled to the liquid ball hole, the spout shaft configured to allow liquid in the closed container to be accessed.

6. The dual ball valve straw lid assembly of claim 5, wherein the lid comprises a spout cavity in a top surface, the spout cavity configured to receive the spout shaft when the liquid ball and the vent ball are in the closed position.

7. The dual ball valve straw lid assembly of claim 5, wherein the spout shaft comprises a ball valve handle, configured to rotate the spout shaft and the liquid ball and the vent ball in response to finger pressure applied to the ball valve handle.

8. The dual ball valve straw lid assembly of claim 4, wherein the vent ball comprises the vent ball hole and a vent slot adjacent and connected to the vent ball hole, wherein the vent slot is oriented along a direction of rotation of the vent ball, as the vent ball rotates from the closed position to the open position, the vent slot aligns with the lid vent hole and allows air pressure to equalize between outside air and an interior of the closed container prior to the liquid ball hole in alignment with the lid liquid hole.

9. The dual ball valve straw lid assembly of claim 8, wherein the vent slot angular displacement about a pivot axis is greater than a radius of the adjacent liquid ball hole.

10. The dual ball valve straw lid assembly of claim 1, further comprising: a liquid seal and a vent seal, disposed between each of the liquid ball and the vent ball and the lid top, respectively, configured to prevent liquid and air leaks between the liquid ball and the vent ball and the lid.

11. The dual ball valve straw lid assembly of claim 10, wherein the lid, the liquid ball and the vent ball are formed from one or more of thermoplastic or thermoset material, wherein the liquid seal and the vent seal are formed from one or more of silicone, rubber, or other compressible material.

12. The dual ball valve straw lid assembly of claim 1, further comprising: a lid sealing surface attached to the lid bottom and configured to provide a liquid seal to the closed container.

13. The dual ball valve straw lid assembly of claim 1, further comprising: a carry handle, mechanically coupled to the lid, configured to allow the closed container to be carried.

14. The dual ball valve straw lid assembly of claim 1, wherein the tube is coupled to the lid bottom surface by one of a friction or compression fit, wherein the tube is removable from the lid to facilitate cleaning of the tube or the lid.

15. The dual ball valve straw lid assembly of claim 1, further comprising: a plurality of spout pivots, extending laterally from the liquid ball and the vent ball, configured to fit within a spout pivot cavity of the lid and allow the liquid ball and the vent ball to rotate about the plurality of spout pivots.

16. The dual ball valve straw lid assembly of claim 15, wherein the spout pivot cavity provides a snap fit for each of the plurality of spout pivots.

* * * * *